United States Patent [19]

Holmes

[11] Patent Number: 4,854,907

[45] Date of Patent: Aug. 8, 1989

[54] "ESU" FLYING RING

[76] Inventor: Stephen E. Holmes, 1310 Sanders Dr., Lake City, Ga. 30260

[21] Appl. No.: 128,022

[22] Filed: Jan. 27, 1988

[51] Int. Cl.[4] ..... A63H 27/00; B64C 3/00; A63B 65/10

[52] U.S. Cl. ..... 446/48; 446/34; 273/425; 244/34 A; D21/3; D21/50

[58] Field of Search ..... 446/46–48, 446/34; 273/424, 425, 426, 427, 327, 336; D21/50, 3, 4, 85, 86; 244/34 A

[56] References Cited

U.S. PATENT DOCUMENTS

| | | | |
|---|---|---|---|
| 18,980 | 4/1889 | Goldman | 273/106 C |
| D. 241,565 | 9/1976 | Molenaar | D21/86 X |
| 248,901 | 11/1881 | Wetherill | 273/425 |
| D. 253,004 | 9/1979 | Meckstroth | D21/86 |
| 281,773 | 7/1883 | Mann | 273/425 |
| 429,531 | 6/1890 | Johnstone | 273/425 |
| 678,265 | 7/1901 | Low | 273/425 |
| 1,986,937 | 1/1935 | MacGregor | 273/425 |
| 1,991,689 | 2/1935 | McClintock | 273/425 |
| 3,312,472 | 4/1967 | Kerr | 446/48 X |
| 3,566,532 | 3/1971 | Wilson | 446/46 |
| 3,590,518 | 7/1971 | LeBaron | 273/425 X |
| 3,765,122 | 10/1973 | English | 446/48 |
| 4,063,382 | 12/1977 | McCallum | 446/48 |
| 4,174,834 | 11/1979 | De Martino | 446/48 X |
| 4,204,680 | 5/1980 | Brown | 273/425 X |
| 4,456,265 | 6/1984 | Adler | 244/34 A X |
| 4,560,358 | 12/1985 | Adler | 273/425 X |

*Primary Examiner*—Robert A. Hafer
*Assistant Examiner*—D. Neal Muir

[57] ABSTRACT

A flying ring of symmetrical cross section featuring a normal leading edge with triangular cross section. The triangle is isosceles and the sides of the triangle may be concave. As the ring is symmetrical, it may be used with "either side up".

3 Claims, 1 Drawing Sheet

"ESU" FLYING RING

FIELD OF THE INVENTION

This invention which I have termed the "ESU" (for "Either Side Up") Flying Ring is a toy in the "Flying Disc" category.

SUMMARY OF THE INVENTION

Figure 1:
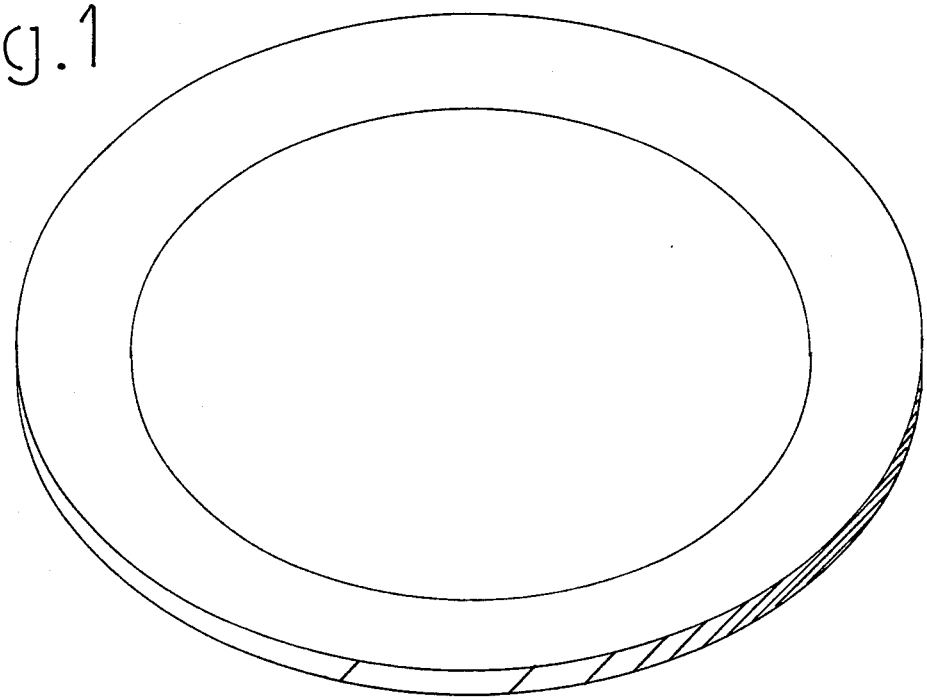
FIG. 1 depicts the complete ring of the prefered embodiment of claim 1.
Figure 2:
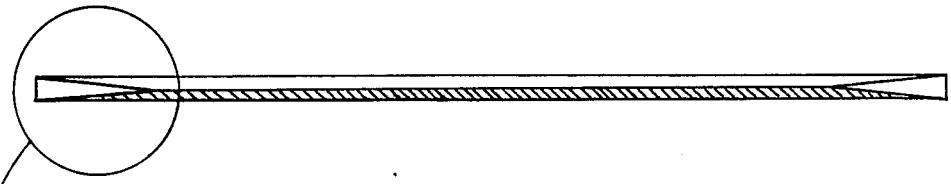
FIG. 2 is a cross-sectional view showing the rings' triangular shape. Also shown are "a"-the flat outer perimeter, "b"-the flat top and bottom surfaces, and "c"-the narrow inner perimeter.
Figure 3:
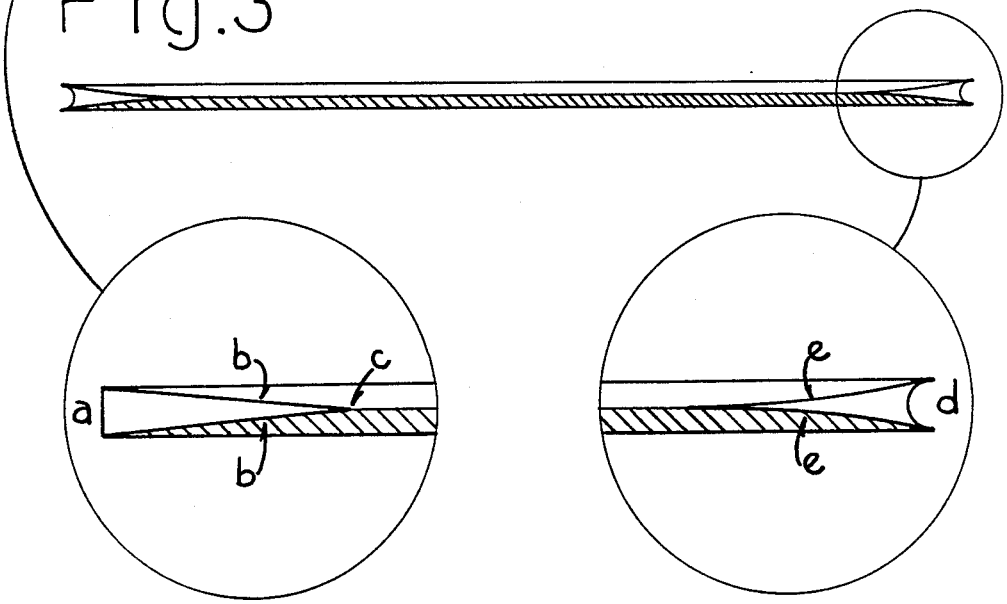
FIG. 3 is a cross-sectional view of the ring with both "d"-a concave outer perimeter, and "e"-concave top and bottom surfaces.

The "ESU" Flying Ring is simply a single piece ring of essentially triangular cross section molded of lightweight ridgid plastic having no holes or protrusions. Its outer circumference is a broad non-convex vertical surface. Its inner circumference is narrow and nearly sharp. Its top and bottom surfaces are identical (whether flat, convex, or concave, it makes no difference) so that the ring does not have the one right side up orientation typical for flying rings, thus distinguishing it from what is old.

These three points are the novelty of this invention:

(1) The broad non-convex outer circumference of the ring.

(2) The wedge shaped inner edge of the ring.

(3) The symmetry of the ring top to bottom.

DESCRIPTION OF THE PREFERRED EMBODIMENTS

Although gyroscopic forces and inertia act together on a spinning flat ring to keep it flying straight and level in the direction that it was thrown, at lower speeds it can be observed to veer to one side under the influence of other forces. Behind any airfoil in flight is a downflow of air, a reaction to the force which lifts the airfoil. Like one wing following close behind another, the back half of a tossed ring looses some of its lift in the downwash of the front half, particularly at lower velocities. The ring then tips down, not in the back as one would suppose, but rather at a point 90 degrees around the ring in the direction of rotation, and tipping to one side it no longer follows a straight course. In order to compensate for this low velocity phenomenon, it is necessary to design into the ring a mechanism for either increasing the lift on the rear half or decreasing the lift on the front half porportionally. The "OSU" ring accomplishes this better than other rings which have been patented, with the added feature of being symmetrical top to bottom and therefor not requiring a one right side up orientation.

The "ESU" Flying Ring has a flat (or concave but not convex) outer edge. At high speeds a cushion of high pressure air builds on this flat leading edge in effect giving the front half of the ring a conventional airfoil shape. The oncoming airstream separates at or about halfway up this flat edge, and the rings front and rear lift are balanced. At a lower velocity when the rear half of the ring tends to have less lift, the high pressure cushion on the leading edge is reduced, and the oncoming air tends to separate lower, in effect reducing the angle of attack of the front half of the ring, reducing its lift porportionally.

I claim:

1. A circular gliding ring of unitary construction comprising an outer perimeter face and an inner edge, said outer perimeter face disposed normal to the diameter of said ring and said inner edge disposed midway between those edges defined by said outer perimeter, said ring consisting of a simple isosceles triangular cross section.

2. A gliding ring as recited in claim 1, having a concave outer edge.

3. A gliding ring as recited in claim 1, having concave top and bottom surfaces.

* * * * *